US005426410A

United States Patent [19]

Niimi

[11] Patent Number: 5,426,410

[45] Date of Patent: Jun. 20, 1995

[54] COIL DEVICE

[75] Inventor: Shigeki Niimi, Kariya, Japan

[73] Assignee: Aisin Seiki Kabushiki Kaisha, Kariya, Japan

[21] Appl. No.: 36,853

[22] Filed: Mar. 25, 1993

[30] Foreign Application Priority Data

Mar. 30, 1992 [JP] Japan ..... 4-074425

[51] Int. Cl.[6] ..... H01F 15/10; H01F 41/04

[52] U.S. Cl. ..... 336/192; 29/602.1; 335/299; 336/205

[58] Field of Search ..... 336/198, 192, 208, 205, 336/96; 29/605, 602.1; 335/299

[56] References Cited

U.S. PATENT DOCUMENTS

| | | | |
|---|---|---|---|
| 3,265,999 | 8/1966 | Kessel | 336/208 |
| 4,380,000 | 4/1983 | Nicolaisen | 336/192 |
| 4,719,440 | 1/1988 | Nakamura et al. | 336/192 |

FOREIGN PATENT DOCUMENTS

| | | | |
|---|---|---|---|
| 1439993 | 4/1966 | France | 336/192 |
| 2350663 | 4/1975 | Germany . | |
| 9107928 | 9/1991 | Germany . | |
| 58-70515 | 4/1983 | Japan | 336/192 |
| 61-69105 | 4/1986 | Japan | 336/192 |
| 3-33046 | 7/1991 | Japan . | |

*Primary Examiner*—Thomas J. Kozma
*Attorney, Agent, or Firm*—Burns, Doane, Swecker & Mathis

[57] ABSTRACT

A coil device comprising a bobbin provided at one end thereof with a flange, a wire wound around the bobbin, a pair of terminals provided on the flange and connected to both ends of the wire, and a device for reducing concentration of stress to the ends of the wire during shrinkage and expansion of the bobbin associated with changes in temperature. A method for producing a coil device can include providing a bobbin having a wound wire and a flange provided at one end portion, partially inserting terminals into respective grooves formed in the flange, connecting ends of the wire to the terminals, and moving the terminals within the grooves to produce slack in the wire.

9 Claims, 4 Drawing Sheets

COIL DEVICE

BACKGROUND OF THE INVENTION

The present invention relates to a coil device used as a solenoid.

In a conventional coil device such as disclosed in Japanese utility model publication No. Hei3(1991)-33046 published after examination, each of the ends of a wire wound around a resin bobbin is connected to a terminal corresponding thereto, and a resin protective layer is provided on parts of the wire and the terminals. When such a coil device is incorporated in a specific apparatus such as a solenoid, those parts are subjected to a concentration of stress if there is a big change in the ambient temperature because of the shrinkage force acting between the ends of the wire and the respective terminals. In this case, there will be no problem if the size of the wire is large enough. However, it is sometimes inevitable that a wire having a small diameter is used in view of the rating of the coil device. In such a case, since there is a possibility of wire disconnection due to the concentration of stress, it is necessary to wind wire with a tension which is somewhat small.

Such approach, however, can result in improper winding, creating a problem that the inductance of the coil can derive from the design value.

SUMMARY OF THE INVENTION

It is, therefore, a primary object of the present invention to provide a coil device without the foregoing drawbacks.

Another object of the present invention is to provide a coil device in which the concentration of stress produced Between the ends of the wire and the respective terminals can be properly handled without making a tension during the winding of the wire somewhat small.

In order to attain the foregoing objects, a coil device comprises a bobbin provided at one end thereof with a flange, a wire wound around the bobbin, a pair of terminals provided on the flange and connected to both ends of the wire, and means for reducing the concentration of stress to the ends of the wire during shrinkage and expansion of the bobbin associated with changes in temperature.

BRIEF DESCRIPTION OF THE DRAWINGS

The above and other objects, features and advantages of the present invention will be more apparent and more readily appreciated from the following detailed description of a preferred exemplarily embodiment of the present invention, taken in connection with the accompanying drawings, in which.

DETAILED DESCRIPTION OF THE PREFERRED EMBODIMENT

A preferred embodiment of the present invention will be described hereinafter with reference to the attached drawings.

Figure 1:
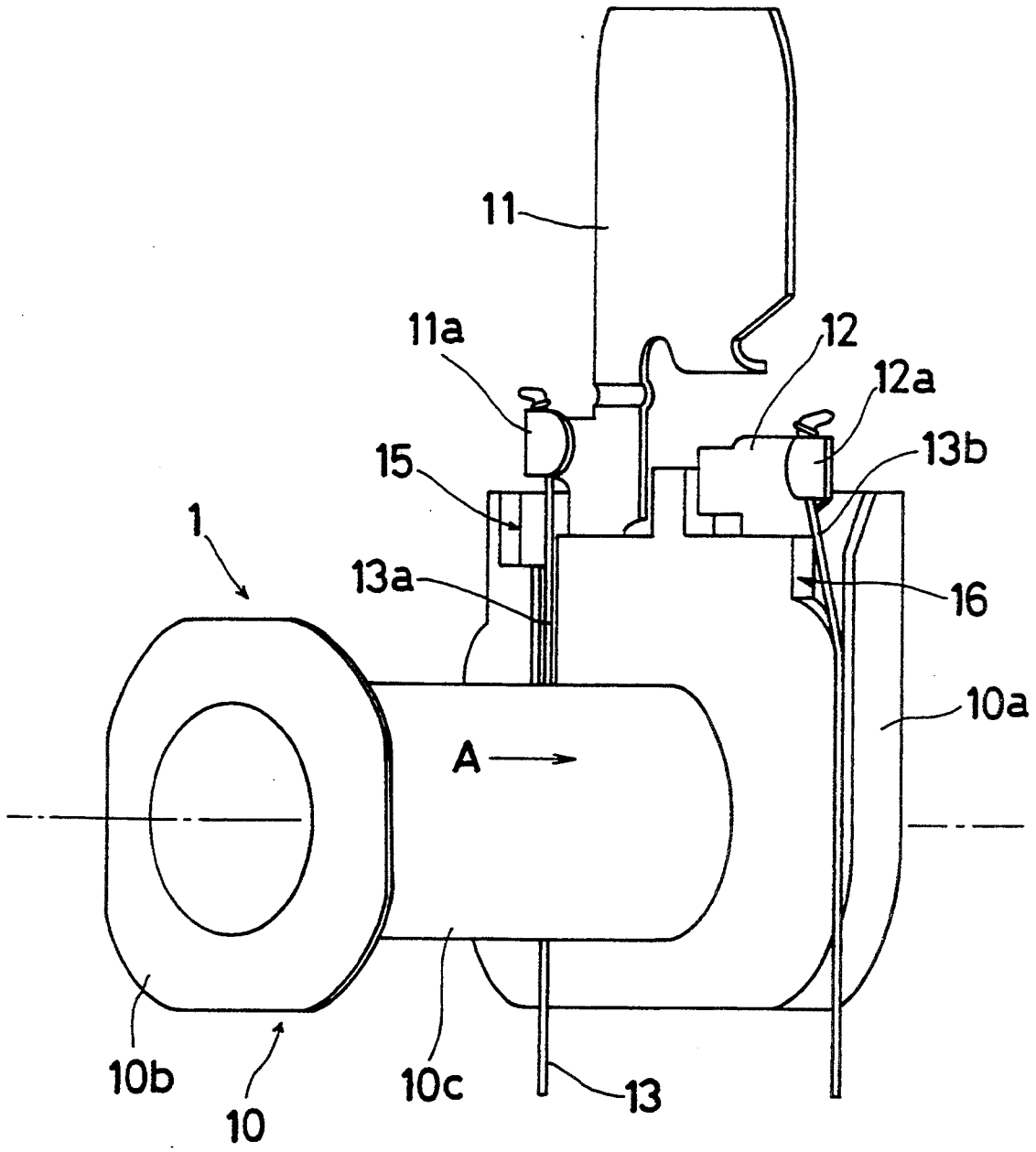
FIG. 1 is a perspective view of a coil device according to the present invention taken during the process of manufacturing the same.
Figure 2:
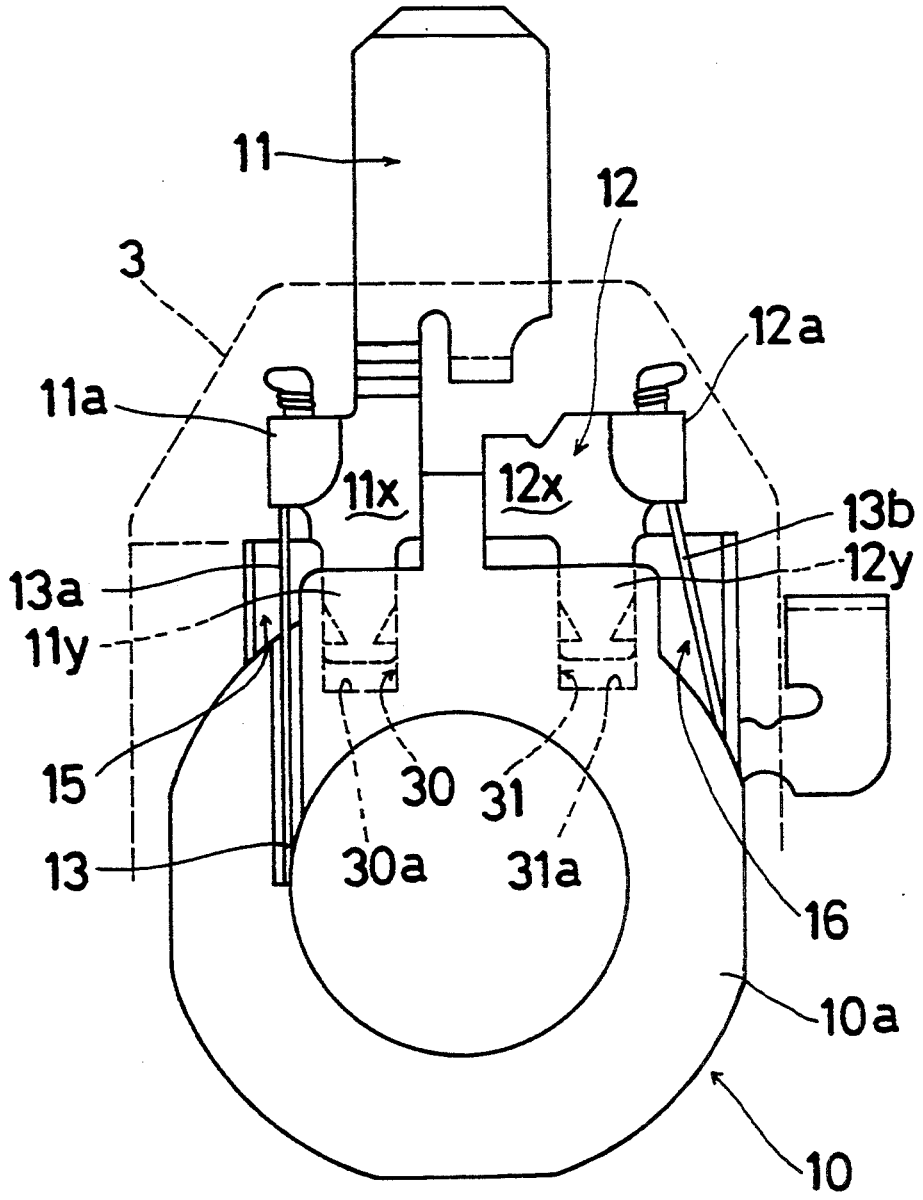
FIG. 2 is a view in the direction of the arrow "A" in FIG. 1.
Figure 3:
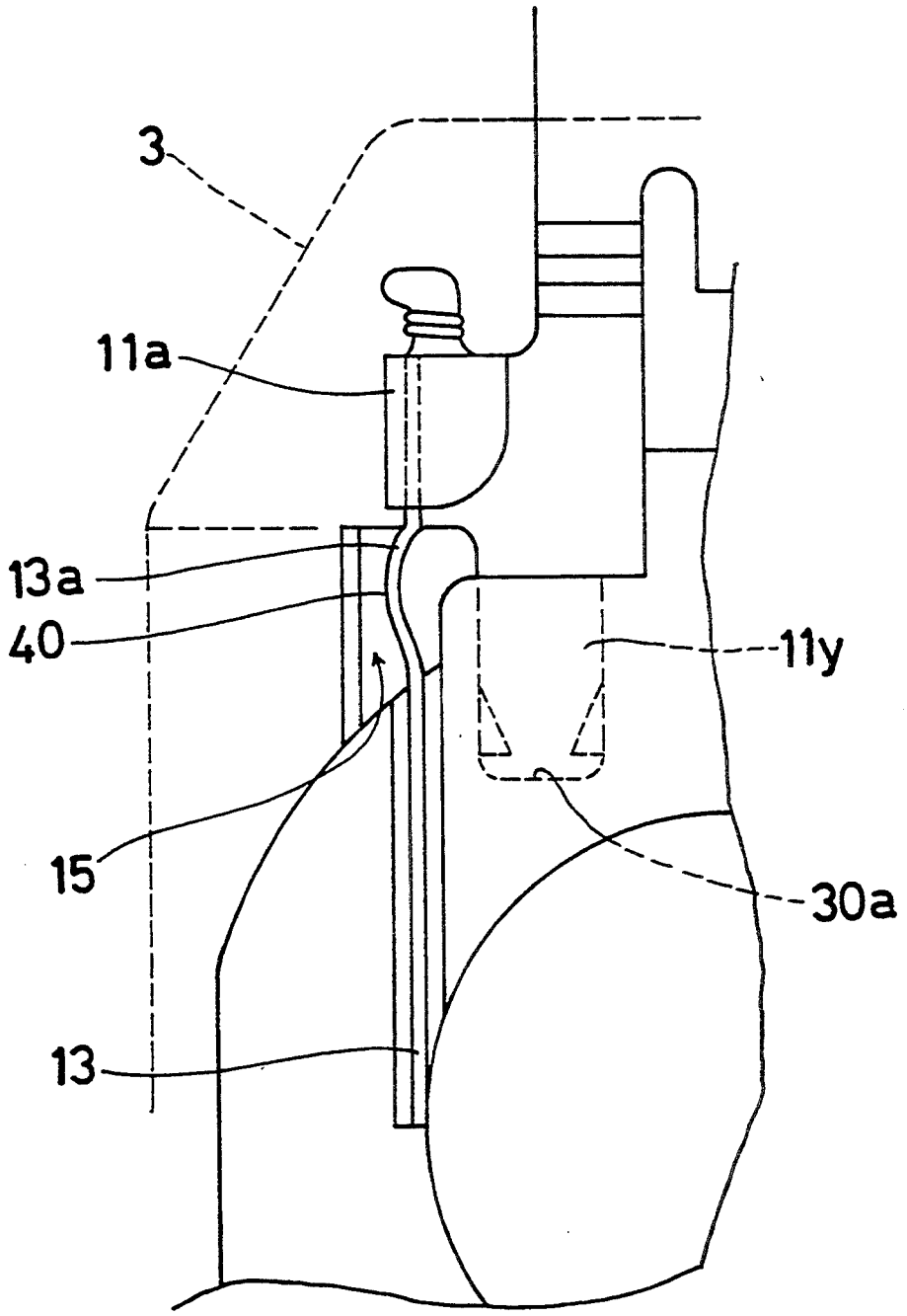
FIG. 3 is a view showing a slack state of a coil device according to the present invention.

Referring now to FIGS. 1 to 3 inclusive, a coil device 1 includes a bobbin 10. The bobbin 10 has a cylindrical portion 10*c* having at its both ends a pair of flanges 10*a* and 10*b*, respectively. A wire 13 is wound around the cylindrical portion 10*c* of the bobbin 10 in a well-known manner, though the wound condition of the wire 13 is not shown. Ends 13*a* and 13*b* of the wire 13 extends along grooves 15 and 16, respectively, which are obtained by cutting the flange portion 10*a*, and are connected to terminals 11*a* and 12*a*, respectively. As will be described later, each of the ends 13*a* and 13*b* of the wire 13 are adapted to form slack 40 in the vicinity of the respective ends 13*a* and 13*b* when the coil device 1 is completed.

The connection of the end 13*a* (13*b*) of the wire 13 to the terminal 11 (12) is accomplished by fusing. Specifically, a gap is formed or defined between a main body portion 11*x* (12*x*) of the terminal 11 (12) and a retaining portion 11*a* (12*a*) which is integrally formed with the main body portion 11*x* (12*x*) and is bent so that it is substantially parallel with the main body portion 11*x* (12*x*), and the end 13*a* (13*b*) of the wire 13 is placed in the gap. In this state, a current is applied from the retaining portion 11*a* (12*a*) to the main body portion 11*x* (12*x*), and the heat produced thereby melts the coating on the end 13*a* (13*b*) of the wire 13. Then, the retaining portion 11*a* (12*a*) is pushed toward the main body portion 11*x* (12*x*), and the end 13*a* (13*b*) of the wire 13 is thereby electrically connected to the terminal 11 (12).

Figure 4:
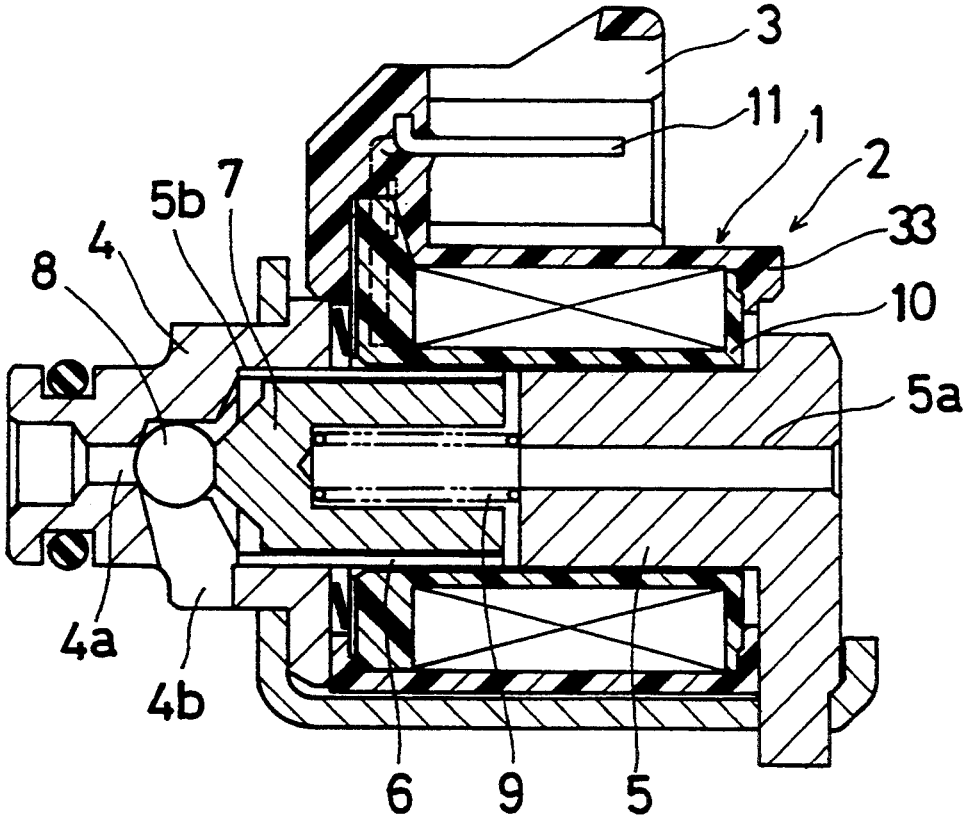
FIG. 4 is a sectional view of a solenoid valve as which a coil device according to the present invention is mounted.

The connection of the end 13*a* (13*b*) of the wire 13 to the terminal 11 (12) as described above is carried out with the terminal 11 (12) incompletely inserted in a groove 30 (31) formed in the flange 10*a*. Specifically, the connection is made with the terminal 11 (12) inserted in the groove 30 (31) so that a gap X is left between it and a bottom wall 30*a* (31*a*) of the groove 30 (31) instead of being completely inserted. When the connection of the end 13*a* (13*b*) of the wire 13 to the terminal 11 (12) is completed, further insertion is made until the tip 11*y* (12*y*) of the terminal 11 (12) abuts against the bottom wall 30*a* (31*a*) of the groove 30 (31), and the ends 13*a* and 13*b* of the wire 13 will have the respective slacks 40 formed in the vicinity of the respective ends 13*a* and 13*b* of the wire 13 as shown in FIG. 4. Thereafter, a connector 3 which is in the form of a molding 33 as shown in FIG. 4 is formed around the wire 13 after molding thereof. A resin hardened by ultraviolet rays which has high plastically is provided in each groove 15 (16) for the connection of the ends 13*a* (13*b*) to the flange 10*a*. The terminals 11 and 12 are not buried in the molding 33. The presence of the slack 40 allows the ends 13*a* and 13*b* to absorb expansion and shrinkage of the bobbin 10 due to change in temperature, thereby preventing disconnection of the wire 13.

The process for manufacturing this coil device 1 is summarized as follows; The manufacturing process for the coil device 1 comprises a first step for preparing the bobbin 10 having, on one end thereof, the flange portion 10*a* in which a pair of grooves 30 and 31 are formed, a second step for inserting a pair of terminals 11 and 12 in the grooves 30 and 31 in the flange portion 10*a* so that the terminals are spaced from the bottom walls 30*a* and 31*a* of the grooves by a predetermined quantity, a third step for connecting the ends 13*a* and 13*b* of the wire 13 to the respective terminals 11 and 12, a fourth step for further inserting the terminals 11 and 12 to which the ends 13*a* and 13*b* of the wire 13 are connected in the respective grooves 30 and 31, and a fifth step for molding the wire 13.

FIG. 4 shows a solenoid valve 2 in which a coil device 1 according to the present invention is used. The solenoid valve 2 has a core 5, and the coil device 1 is mounted on the core 5. The coil device 1 is coupled together with a connector 3 from which the terminal 11 is exposed in a state in which it is bent by approximately 90 degrees. A small diameter portion 5*a* and a large diameter portion 5*b* are formed in the core 5. The core 5 is connected, at the large diameter portion 5*b* thereof, to a base member 4 on which an orifice 4*a* and a drain port 4*b* are formed. A sleeve is disposed at the large diameter portion 5*b* of the core 5, and a plunger 7 which axially slides when the coil device 1 is excited is disposed in the sleeve 6. A valve ball 8 which controls communication between the orifice 4*a* and the drain port 4*b* is disposed between the plunger 7 and the base member 4, and the plunger 7 is continually urged against the valve ball 8 by a spring 9. When the solenoid 2 which is of the foregoing structure is mounted on a motor vehicle, since the motor vehicle is used in an environment in which big changes in temperature take place, there is a great advantage that the disconnection of the wire 13 of the coil device 1 is avoided and reliability of the mechanisms or devices associated therewith is guaranteed.

As described above, according to the present invention, the slack 40 in the vicinity of the ends 13*a* and 13*b* of the wire 13 absorbs expansion and shrinkage of the bobbin 10 due to change in the ambient temperature. This results in a great advantage that the wire 13 is not disconnected and the reliability of not only the coil device 1 but also of the mechanisms or devices associated therewith is guaranteed.

Obviously, many modifications and variations of the present invention are possible in the light of the above teachings. It is, therefore, to be understood that within the scope of the appended claims, the invention may be practised otherwise than as specifically described.

What is claimed is:

1. A coil device comprising:

a bobbin provided at one end thereof with a flange, said flange being provided with a pair of grooves;

a wire wound around the bobbin, said wire having two ends;

a pair of terminals provided on the flange, each end of the wire extending along a corresponding one of the grooves and being connected to one of the terminals;

means for reducing concentration of stress to the ends of the wire during shrinkage and expansion of the bobbin associated with changes in temperature, said means for reducing concentration of stress to the ends of the wire including slack formed in each end of the wire, and an elastic resin connecting each slackened wire end to the corresponding one of the grooves; and a molding provided around the wire.

2. A coil device comprising:

a bobbin having an end portion at which is located a flange, said flange being provided with two grooves;

a wire wound around the bobbin, said wire having opposite ends;

a pair of terminals mounted on the flange, each end of the wire being connected to a respective one of the terminals, each end of the wire extending through a respective one of the grooves and being slackened so that slack exists at each end of the wire; and plastic resin connecting each slackened end of the wire to the respective groove.

3. A method for producing a coil device, comprising:

providing a bobbin having an end portion, a flange located adjacent the end portion, a pair of first grooves disposed in the flange, and a wound wire;

inserting a terminal into each of the first grooves so that an end of each terminal is spaced from a bottom wall of the respective first groove;

connecting each end of the wire to a respective one of the terminals so that each end of the wire extends along a respective second groove formed in the flange;

moving each terminal within the respective first groove so that the end of the terminal moves toward the bottom wall of the respective first groove thereby creating slack in each end of the wire;

connecting each end of the wire to the respective second groove through the use of plastic resin; and forming a molding around each end of the wire.

4. A method according to claim 3, wherein each end of the wire is connected to the respective terminal by fusing.

5. A method for producing a coil device, comprising:

providing a bobbin having an end portion, a flange located adjacent the end portion, a pair of terminals mounted on the flange, and a wound wire;

electrically connecting each end of the wire to one of the terminals so that each end of the wire extend along a respective groove provided in the flange;

creating slack in the ends of the wire after the ends of the wire are electrically connected to the terminals in order to reduce stress concentrations in the ends of the wire during shrinkage and expansion of the bobbin associated with temperature changes; and connecting each end of the wire to the respective groove through application of a plastic resign.

6. A method according to claim 5, wherein said flange includes two additional grooves which each have a bottom wall, each terminal being movably disposed in one of the additional grooves, said step of creating slack in the wire including moving each terminal towards the bottom wall of the respective additional groove after the ends of the wire have been electrically connected to the terminals.

7. A method according to claim 5, wherein the ends of the wire are electrically connected to respective terminals by fusing.

8. A method according to claim 3, wherein the resin is hardened by ultraviolet rays.

9. A method according to claim 5, wherein the resin is hardened by ultraviolet rays.

* * * * *